US008142207B1

(12) United States Patent
Ljubijankic et al.

(10) Patent No.: US 8,142,207 B1
(45) Date of Patent: Mar. 27, 2012

(54) QSFP RECEPTACLE WITH GROUNDING PLATE AND NOISE CANCELLATION

(75) Inventors: Zlatan Ljubijankic, Mississauga (CA); Adrian Green, Newcastle (CA); Alex Persaud, Endicott, NY (US)

(73) Assignee: Amphenol Canada Corporation, Toronto (CA)

( * ) Notice: Subject to any disclaimer, the term of this patent is extended or adjusted under 35 U.S.C. 154(b) by 0 days.

(21) Appl. No.: 13/007,007

(22) Filed: Jan. 14, 2011

(51) Int. Cl.
*H01R 4/66* (2006.01)

(52) U.S. Cl. ..... 439/95

(58) Field of Classification Search ..... 439/79, 439/80, 95, 108, 541.5, 607.11, 607.23, 607.25, 439/607.26, 607.55, 628, 660, 701
See application file for complete search history.

(56) References Cited

U.S. PATENT DOCUMENTS

| | | | | |
|---|---|---|---|---|
| 4,687,267 | A | 8/1987 | Header et al. | |
| 6,053,751 | A | 4/2000 | Humphrey | |
| 6,296,496 | B1 | 10/2001 | Trammel | |
| 7,128,611 | B2 | 10/2006 | Tanaka | |
| 7,534,150 | B2 | 5/2009 | Shen et al. | |
| 7,648,390 | B2 | 1/2010 | Zhang et al. | |
| 7,708,601 | B2 | 5/2010 | Tanaka | |
| 7,789,705 | B2 * | 9/2010 | Morgan | 439/607.07 |
| 2003/0109174 | A1 * | 6/2003 | Korsunsky et al. | 439/541.5 |
| 2004/0077227 | A1 | 4/2004 | Wu | |
| 2007/0173103 | A1 * | 7/2007 | Ellis et al. | 439/404 |
| 2010/0167594 | A1 | 7/2010 | Lee et al. | |

* cited by examiner

*Primary Examiner* — Edwin A. Leon
(74) *Attorney, Agent, or Firm* — Blank Rome LLP

(57) ABSTRACT

A QSFP receptacle includes a grounding plate in the housing between the first and second contact arrays such that the first and second contact arrays are equidistant from the grounding plate and a noise cancellation member making electrical contact with the grounding contacts of the first and second contact arrays and the grounding plate to provide an electrical connection among the grounding contacts of the first and second contact arrays and the grounding plate.

11 Claims, 6 Drawing Sheets

QSFP RECEPTACLE WITH GROUNDING PLATE AND NOISE CANCELLATION

FIELD OF THE INVENTION

The present invention is directed to a receptacle for electronic equipment, such as a QSFP receptacle, and more particularly to such a receptacle having a grounding plate and a noise canceling member using the grounding plate.

DESCRIPTION OF RELATED ART

The small form-factor pluggable (SFP) or Mini-GBIC is a compact, hot-pluggable transceiver used for both telecommunication and data communications applications. It interfaces a network device mother board (for a switch, router, media converter or similar device) to a fiber optic or copper networking cable. It is a popular industry format supported by many network component vendors. SFP transceivers are designed to support SONET, Gigabit Ethernet, Fiber Channel, and other communications standards. An SFP transceiver includes a printed circuit board with a receptacle that mates with a connector.

A variation of SFP, known as QSFP (Quad SFP), allows four channels of 10 Gb/s each, or 40 Gb/s. The QSFP technical specification is found at ftp://ftp.seagate.com/sff/INF-8438.PDF, which is hereby incorporated by reference in its entirety into the present disclosure.

The pin layout of a QSFP receptacle is shown in FIG. 1. As shown, there are 38 pins, namely, an upper row of 19 pins and a lower row of 19 pins. Each row includes six ground pins, for a total of twelve. The use of so many ground pins can cause undesirable noise.

Various similar receptacles known in the art will now be described.

U.S. Pat. No. 6,296,496 to Trammel discloses a receptacle connector that includes a metal housing and a pair of terminal inserts assembled in the housing, wherein the inserts have a plurality of single contacts insert molded therein, as seen in FIG. 2 of that reference. Each terminal insert includes first and second terminal cores stacked together and a ground plate sandwiched therebetween. Each of the terminal cores has a plurality of signal contacts insert molded therein. The signal contacts are arrayed in two rows, facing each other for electrically connecting to circuit board. Each signal contact has an elongated beam having a contact portion and a contact tail. Each ground plate forms a plurality of ground tails extending out of the housing. Each ground tail is formed in a substantially L shape and has a distal end proximate the contact tail.

U.S. Pat. No. 4,687,267 to Header et al discloses a circuit board edge connector that is mounted on a circuit board with first and second contact elements, electrically engaging the board. The connector includes a blade which projects outwardly from the edge of the board for insertion into a mating connector. The contact elements include pins which are received and soldered in plated thru holes in the board; as seen in FIG. 9 of that reference, a conductive ground plane is insert molded into the blade. The ground plane extends on the length of the blade with conductive connecting links extending outwardly from the plane to opposing surfaces of contact elements to make electrical contact therewith. The ground plane serves to reduce crosstalk between the contact elements as well as providing a ground connection. The plane also improves the impedance/capacitance characteristics of the connector. See column 5, lines 51-55.

U.S. Pat. No. 7,128,611 to Tanaka discloses an electrical connector that includes signal contact pairs and ground contacts there between. As seen in FIG. 2 of that reference, the connector has an insulator, a plurality of signal contacts and a plurality of ground contacts. The ground contacts include ground support segments (FIG. 4 of the reference), first ground connection segments extending as one of contact terminals from the first ends of the ground support segment, and an intermediate segment connecting the ground support segment and second ground connection segments extending as another of the contact terminals from the intermediate section and is both adjacent to the second ends of the ground support segment. The single contact and the ground contact are divided into four groups so that impedance matching can be maintained. See column 4, lines 58-60.

U.S. Pat. No. 6,053,751 to Humphrey discloses a high density electrical connector that has a female connector portion with a plurality of spring contacts that are of the gull wing type, as seen in FIG. 11 of that reference. The connector also includes a ground plane connector for connecting a ground contact pad on a mother board to the ground plane contacts of the male connector portion.

However, none of the above-cited references disclose a technique for overcoming the above-noted difficulty with noise.

SUMMARY OF THE INVENTION

There thus exists a need in the art to improve noise cancellation.

It is therefore an object of the invention to provide such improved noise cancellation.

To achieve the above and other objects, the present invention in at least some embodiments is directed to a QSFP or other receptacle that includes a grounding plate in the housing between the first and second contact arrays such that the first and second contact arrays are equidistant from the grounding plate and a noise cancellation member making electrical contact with the grounding contacts of the first and second contact arrays and the grounding plate to provide an electrical connection among the grounding contacts of the first and second contact arrays and the grounding plate.

Features of the invention in various embodiments include insert molded construction, a grounding plate between the top and bottom rows of contacts, a noise cancellation member which at the same time commons the ground plate and all grounding contacts to provide grounding circuitry, two (or any number) additional grounding pads to connect the grounding circuit to the printed circuit board and to increase connector retention to the printed circuit board, a lack of rear plastic standoffs to improve visibility for inspecting the solder joints, stamped and formed contacts to eliminate mating on the cut edge, and a gull-wing contact design ensuring that the upper and lower contacts are equidistant from the grounding plate.

BRIEF DESCRIPTION OF THE DRAWINGS

A preferred embodiment of the present invention will be set forth in detail with reference to the drawings, in which.

DETAILED DESCRIPTION OF THE PREFERRED EMBODIMENT

Figure 1:
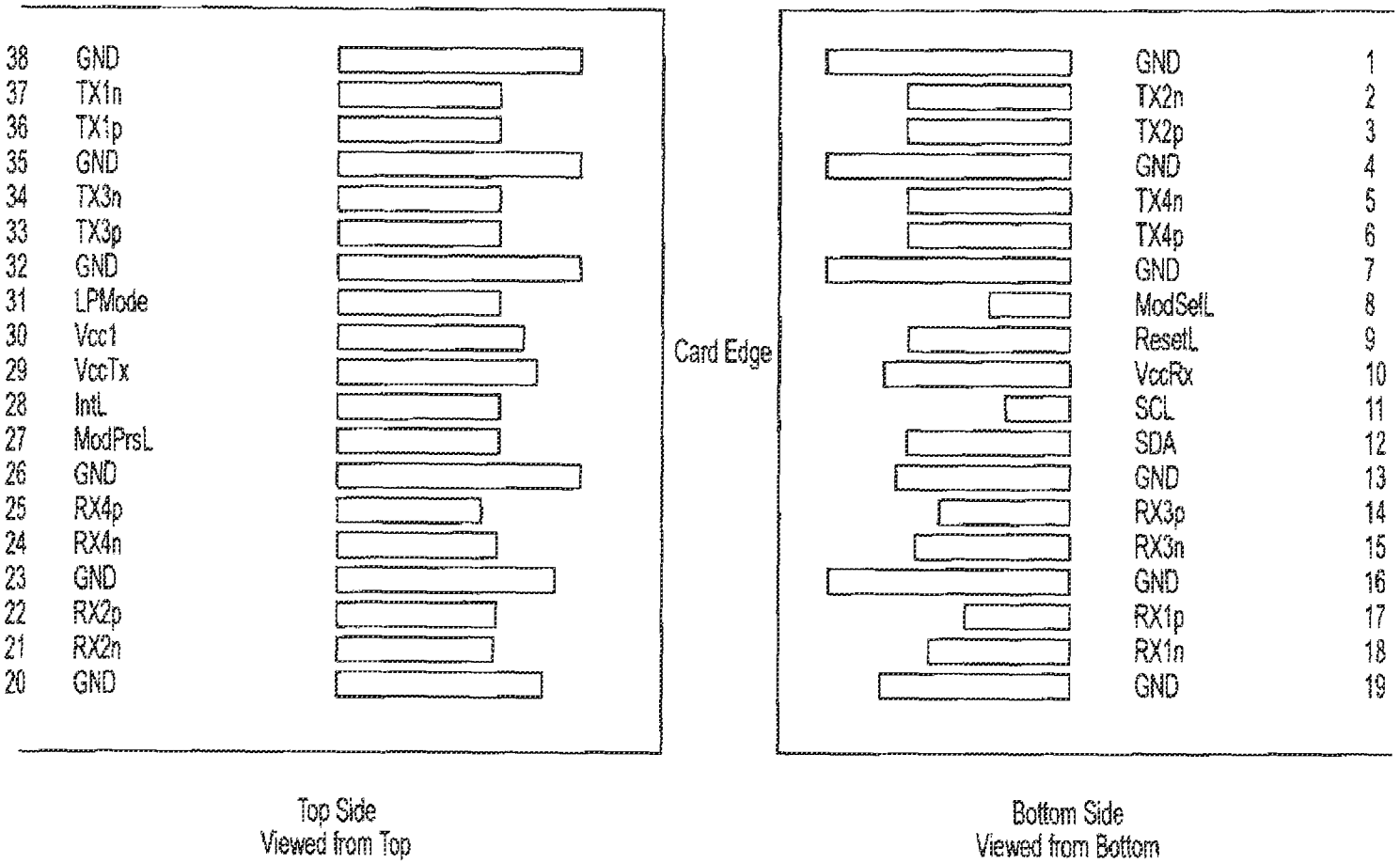
FIG. 1 PRIOR ART
FIG. 1 is a pin-out diagram of a conventional QSFP receptacle.

A preferred embodiment of the present invention will be set forth in detail with reference to the drawings, in which like reference numerals refer to like elements throughout.

Figure 2:
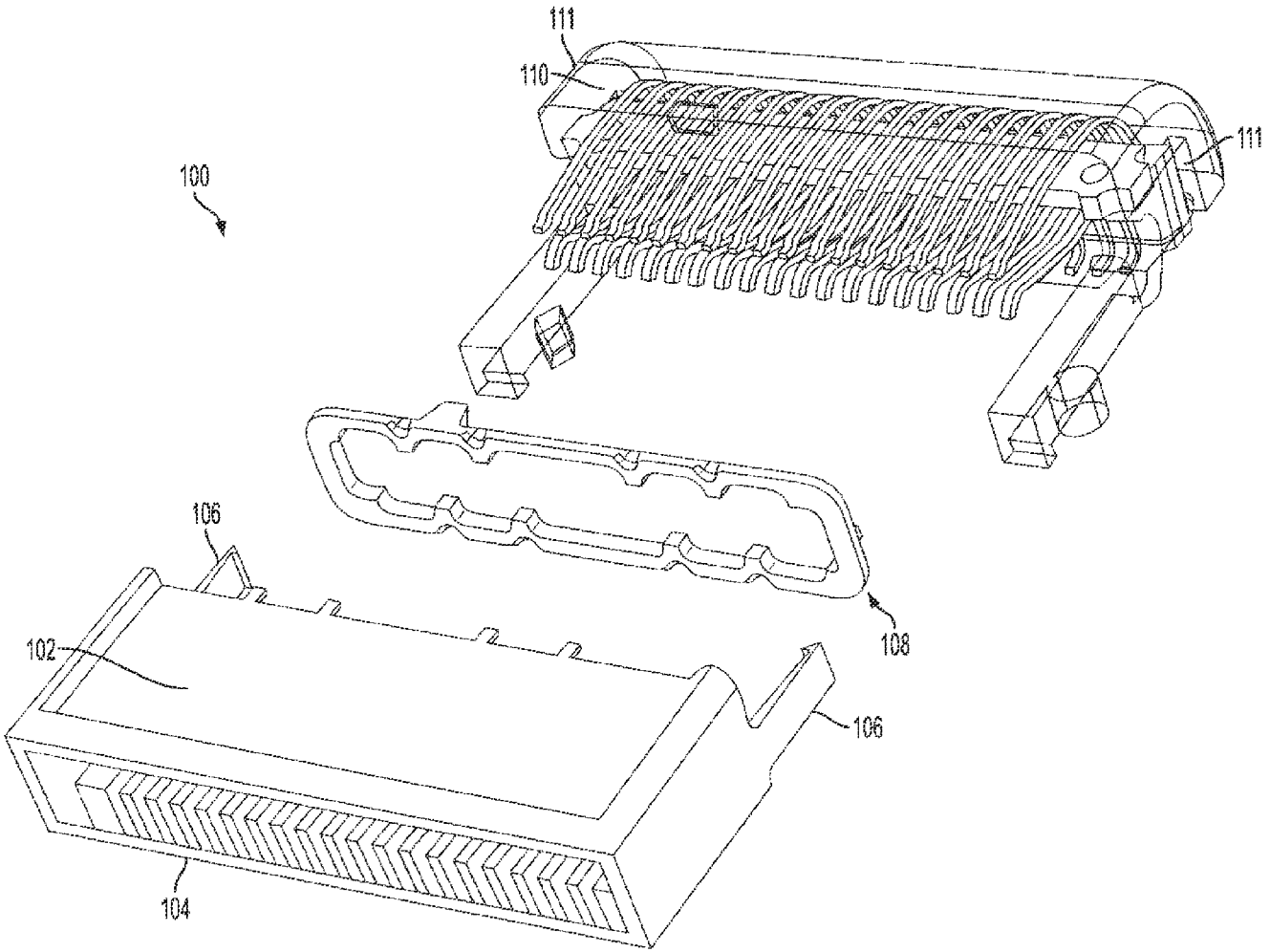
FIG. 2 shows an exploded view of a receptacle according to the preferred embodiment.

FIG. 2 shows an exploded view of a receptacle 100 according to the preferred embodiment. The receptacle includes a front insert 102 with an aperture 104 for receiving contacts from a mating connector (not shown) and latching arms 106 for assembly, a noise cancellation member 108 formed of a conductive material, and a molded rear insert 110 having slots 111 for receiving the latching arms 106 of the front insert. When assembled and latched together by means of the latching arms 106 and the slots 111, the front and rear inserts 102, 110 form the housing.

Figure 3:
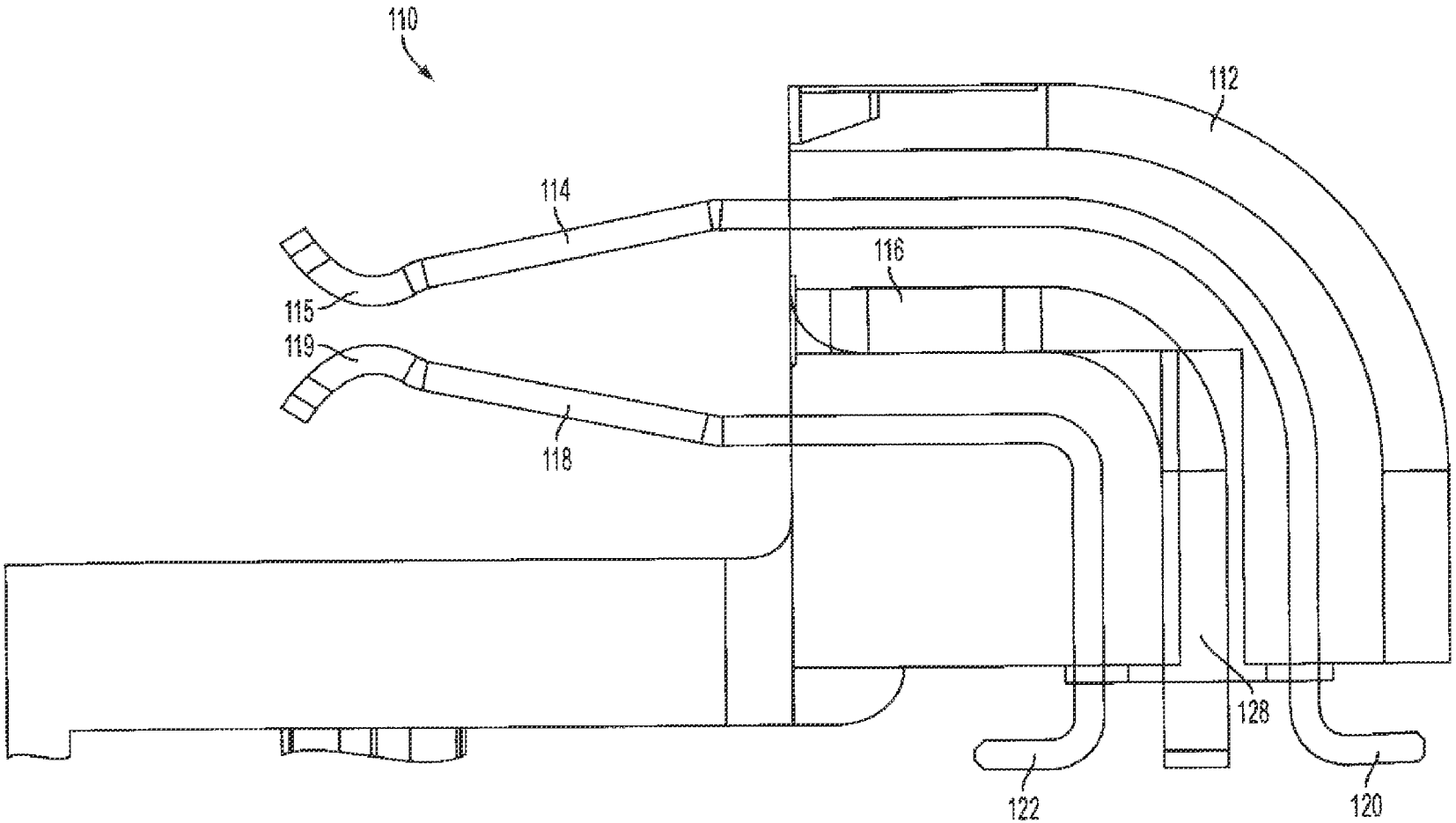
FIG. 3 shows a cross-sectional view of a molded insert in the receptacle of FIG. 2.

FIG. 3 shows a cross-sectional view of the molded rear insert 110. The insert 110 is formed by molding an insulating body 112 such that top contacts 114, a grounding plate 116, and bottom contacts 118 are molded into the insulating body 112. The grounding plate 116 is equidistant between the top contacts 114 and the bottom contacts 118. The top and bottom contacts 114, 118 are formed by a stamping and forming process to eliminate mating on cut edges. That is, the contacts 114, 118 are not cut out of a sheet of conducting material in the same shape in which they will be used, since otherwise the edges 115, 119 that the connector contacts would be cut edges; instead, they are stamped out and then reshaped. The top and bottom contacts 114, 118 terminate at gull-wing contact pads 120, 122 respectively.

Figure 4:
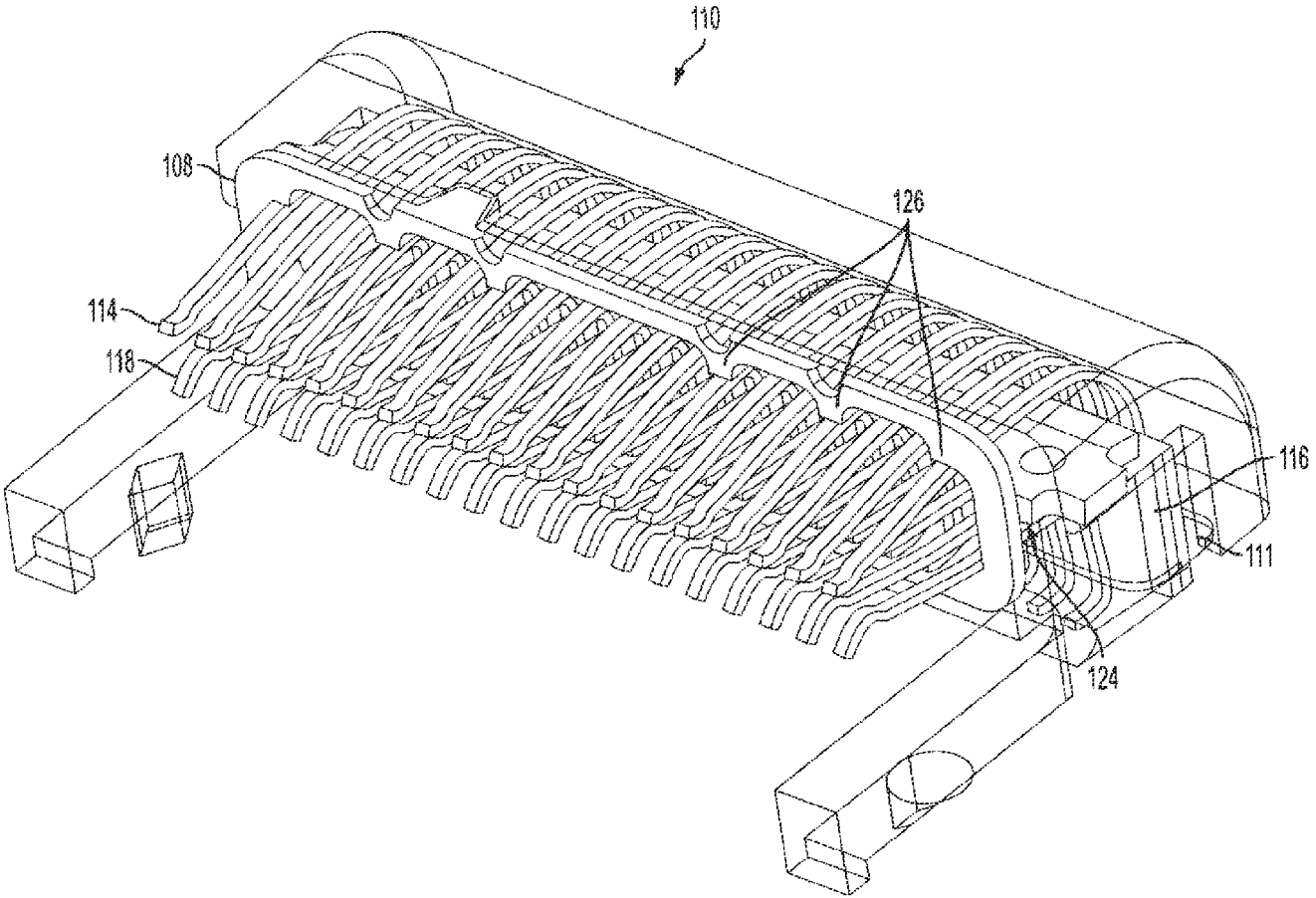
FIG. 4 shows a perspective view of the molded insert and a noise cancellation feature of the receptacle of FIG. 2.

FIG. 4 shows a perspective view of the molded rear insert 110 with the noise cancellation member 108 mounted thereon. Electrical contact between the noise cancellation member 108 and the grounding plate 116 is provided by crush pins 124 on the forward face of the grounding plate. The noise cancellation member also has contacts 126 that extend inwardly from the member for contacting those of the top contacts 114 and the bottom contacts 118 that are ground contacts. Thus, the grounding plate 116 and all of the contacts 114, 118 that are ground contacts are electrically connected.

Figure 5:
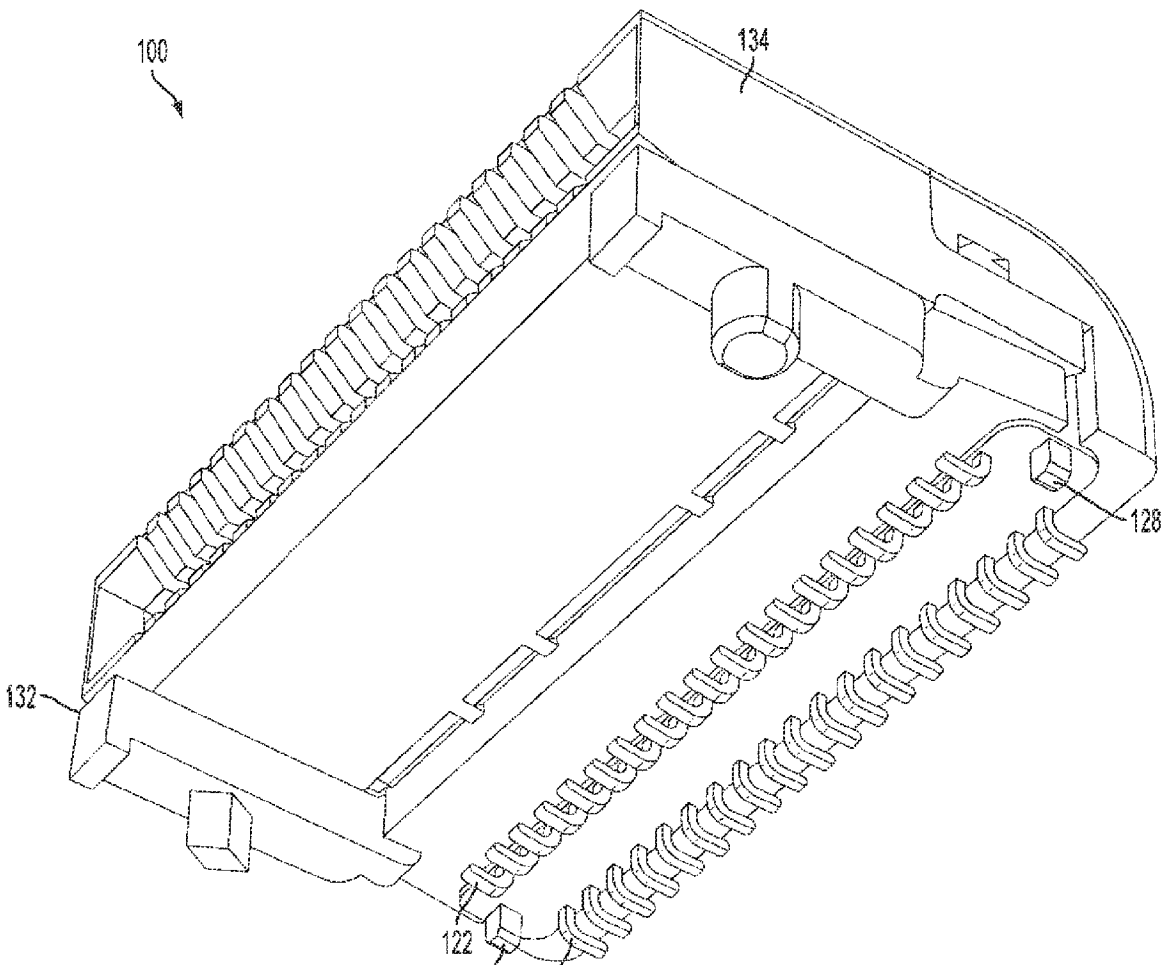
FIG. 5 shows a bottom perspective view of the receptacle of FIG. 2.

FIG. 5 shows a bottom perspective view of the assembled receptacle 100. In addition to the gull-wing contact pads 120, 122, two additional grounding pads 128, which are extensions of the grounding plate 116, protrude from the body 112 to contact a printed circuit board (not shown) to which the receptacle 100 is mounted. The printed circuit board has contact pads corresponding to the contact pads 120, 122 and the grounding pads 128. The front insert 102 has standoffs 132, 134 to separate the receptacle 100 from the printed circuit board onto which it is to be mounted.

Figure 6:
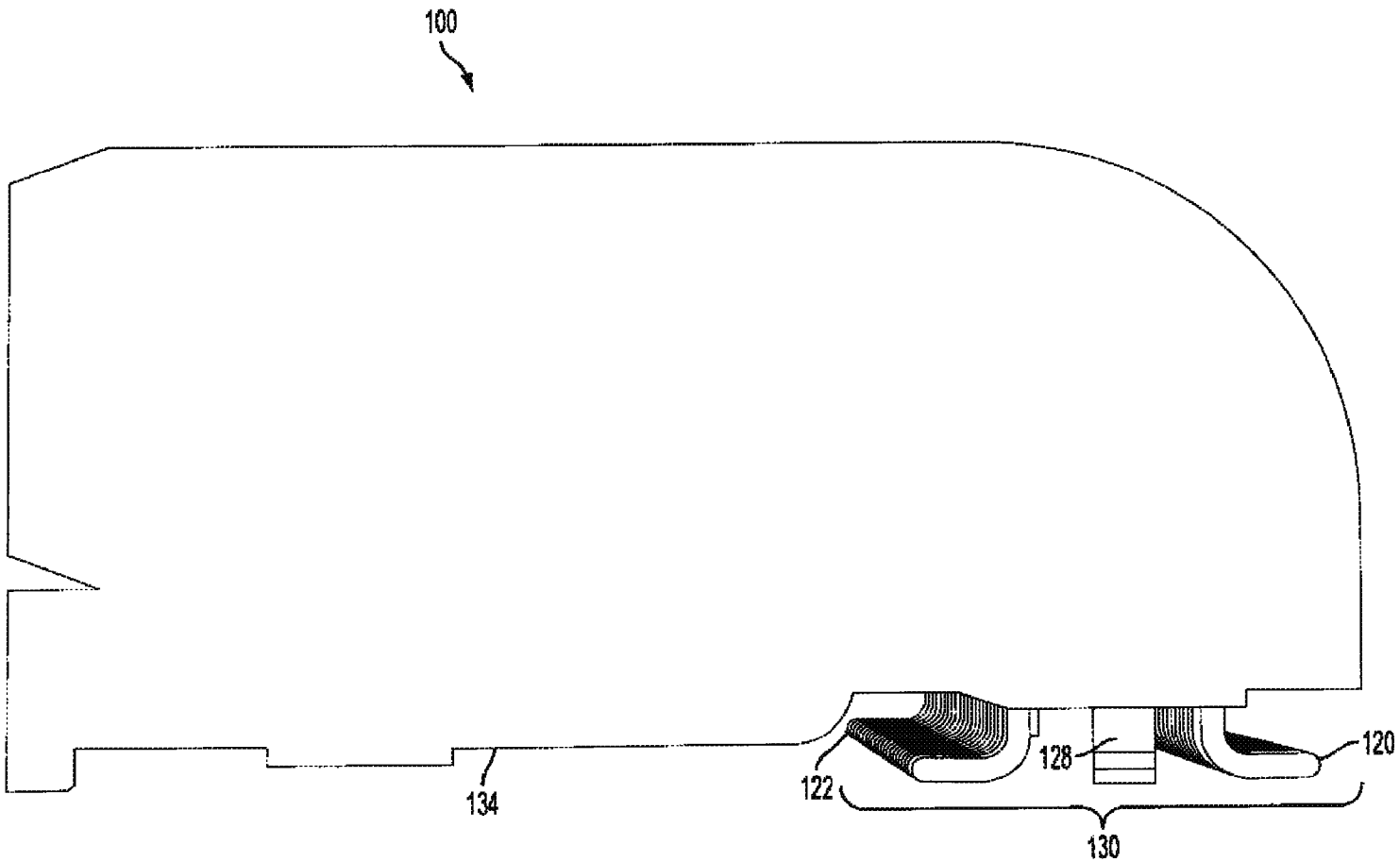
FIG. 6 shows a side view of the receptacle of FIG. 2.

FIG. 6 shows a side view of the assembled receptacle 100. As shown, the gull-wing contact pads 120, 122 and the grounding pads 128 protrude from a portion 130 of the insulating body 112 having no plastic rear standoffs (as opposed to the standoffs 132, 134 on the front of the receptacle), thereby improving visibility for SMT solder joint inspection.

While a preferred embodiment of the present invention has been set forth in detail above, those skilled in the art who have reviewed the present disclosure will readily appreciate that other embodiments can be realized within the scope of the present invention. For example, specific numbers of components are illustrative rather than limiting and can be varied in accordance with the standard to be implemented. Therefore, the present invention should be construed as limited only by the appended claims.

What is claimed is:

1. A receptacle for providing an electrical connection between a printed circuit board device and a connector, the receptacle comprising:

a housing for receiving contacts from the connector;

opposing first and second contact arrays in the housing, each of the first and second contact arrays comprising a plurality of contacts including a plurality of ground contacts, the first and second contact arrays being disposed to make electrical contact with the contacts from the connector;

a grounding plate in the housing, the grounding plate being disposed between the first and second contact arrays such that the first and second contact arrays are equidistant from the grounding plate; and a noise cancellation member surrounding the first and second contact arrays, the noise cancellation member making electrical contact with the grounding contacts of the first and second contact arrays and the grounding plate to provide an electrical connection among the grounding contacts of the first and second contact arrays and the grounding plate.

2. The receptacle of claim 1, wherein the grounding plate terminates in at least one grounding pad extending outside of the housing for connection to the device.

3. The receptacle of claim 2, wherein the grounding plate terminates in two of said grounding pads.

4. The receptacle of claim 2, wherein the first and second contact arrays terminate in contact pads extending outside of the housing for connection to the device.

5. The receptacle of claim 4, wherein the contact pads comprise bent portions that are bent away from the grounding plate.

6. The receptacle of claim 4, wherein the housing comprises a portion lacking rear standoffs, and wherein the at least one grounding pad and the contact pads extend outside of the portion of the housing lacking the rear standoffs.

7. The receptacle of claim 1, wherein the grounding plate comprises crush pins for making the electrical contact with the noise cancellation member.

8. The receptacle of claim 1, wherein the housing comprises:

a rear insert into which the first and second contact arrays and the grounding plate are molded; and a front insert having an opening for receiving the contacts from the connector.

9. The receptacle of claim 8, wherein the noise cancellation member is disposed between the front and rear inserts.

10. A method for making a receptacle for providing an electrical connection between a printed circuit board device and a connector, the receptacle comprising:

a housing for receiving contacts from the connector;

opposing first and second contact arrays in the housing, each of the first and second contact arrays comprising a plurality of contacts including a plurality of ground contacts, the first and second contact arrays being disposed to make electrical contact with the contacts from the connector;

a grounding plate in the housing, the grounding plate being disposed between the first and second contact arrays such that the first and second contact arrays are equidistant from the grounding plate; and a noise cancellation member surrounding the first and second contact arrays, the noise cancellation member making electrical contact with the grounding contacts of the first and second contact arrays and the grounding plate to provide an electrical connection among the grounding contacts of the first and second contact arrays and the grounding plate;

the method comprising:

(a) forming a rear insert by molding such that the first and second contact arrays and the grounding plate are molded into the insert;

(b) attaching the noise cancellation member to the first and second contact arrays and the grounding plate to provide the electrical contact with the grounding contacts of the first and second contact arrays and the grounding plate; and (c) attaching a front insert to the rear insert, the front insert having an opening for receiving contacts from the connector, wherein the front and rear inserts define the housing.

11. The method of claim 10, wherein the first and second contact arrays are produced by a stamping and forming process.

* * * * *